US005460280A

United States Patent [19]

Feddeler

[11] Patent Number: 5,460,280

[45] Date of Patent: Oct. 24, 1995

[54] SUSPENDED STORAGE ASSEMBLY

[76] Inventor: Steven E. Feddeler, 7904 Pebble Creek Pl., Fort Wayne, Ind. 46835

[21] Appl. No.: 194,062

[22] Filed: Feb. 9, 1994

[51] Int. Cl.[6] ..... A47F 5/08

[52] U.S. Cl. ..... 211/116; 211/119; 248/317; 312/248

[58] Field of Search ..... 211/116, 117, 211/118, 113, 119, 86, 106, 168, 170; 248/343, 317, 316.8, 324; 312/245, 248, 327

[56] References Cited

U.S. PATENT DOCUMENTS

| | | | |
|---|---|---|---|
| D. 263,183 | 2/1982 | Laurenzi | D6/113 |
| 803,274 | 10/1905 | Deaver | 211/119 |
| 3,331,645 | 7/1967 | Vercellotti | 312/248 |
| 3,786,933 | 1/1974 | Vianzon | 211/90 |
| 3,901,165 | 8/1975 | Schlesinger | 108/149 |
| 4,316,545 | 2/1982 | Hartnell | 211/60 |
| 4,377,114 | 3/1983 | Fuller | 108/103 |

*Primary Examiner*—Leslie A. Braun
*Assistant Examiner*—Anita M. King

[57] ABSTRACT

A storage basket is arranged for pivoted mounting to a ceiling structure such as in a garage and the like, wherein support flanges pivotally mount the basket therebetween, with the support flanges including latch means for securement of the basket in a horizontal orientation and wherein actuation means are provided to selectively release the latch means to permit pivotal movement of the basket to a vertical orientation. The basket is formed of side wall frames having mesh side walls therewithin, as well as a mesh floor and mesh end walls. Shelf frame members are mounted within the basket structure with a partition frame movably mounted within the basket to provide for adjustment of the storage division within the basket.

7 Claims, 4 Drawing Sheets

SUSPENDED STORAGE ASSEMBLY

BACKGROUND OF THE INVENTION

1. Field of the Invention

The field of invention relates to storage apparatus, and more particularly pertains to a new suspended storage assembly wherein the same is arranged for mounting to a ceiling of a dwelling structure and the like.

2. Description of the Prior Art

Various suspended storage structure is available in the prior art as indicated in U.S. Pat. Nos. 4,377,114; 3,901,165; 3,786,933; and 4,316,545.

The instant invention attempts to overcome deficiencies of the prior art by providing for a basket structure arranged for ease of access, as well as convenience in its manipulation and in these respects, the present invention substantially fulfills this need.

SUMMARY OF THE INVENTION

In view of the disadvantages inherent in the known types of storage apparatus now present in the prior art, the present invention provides a suspended storage assembly wherein the same is arranged for mounting to a ceiling of a garage structure. As such, the general purpose of the present invention, which will be described subsequently in greater detail, is to provide a new suspended storage assembly apparatus and method which has many of the advantages of the prior art listed heretofore and many novel features that result in a suspended storage assembly apparatus which is not anticipated, rendered obvious, suggested, or even implied by any of the prior art, either alone or in any combination thereof.

To attain this, the present invention provides a storage basket arranged for pivoted mounting to a ceiling structure such as in a garage and the like, wherein support flanges pivotally mount the basket therebetween, with the support flanges including latch means for securement of the basket in a horizontal orientation and wherein actuation means are provided to selectively release the latch means to permit pivotal movement of the basket to a vertical orientation. The basket is formed of side wall frames having mesh side walls therewithin, as well as a mesh floor and mesh end walls. Shelf frame members are mounted within the basket structure with a partition frame movably mounted within the basket to provide for adjustment of the storage division within the basket.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new suspended storage assembly apparatus and method which has many of the advantages of the prior art listed heretofore and many novel features that result in a suspended storage assembly apparatus which is not anticipated, rendered obvious, suggested, or even implied by any of the prior art, either alone or in any combination thereof.

It is another object of the present invention to provide a new suspended storage assembly which may be easily and efficiently manufactured and marketed.

It is a further object of the present invention to provide a new suspended storage assembly which is of a durable and reliable construction.

An even further object of the present invention is to provide a new suspended storage assembly which is susceptible of a low cost of manufacture with regard to both materials and labor, and which accordingly is then susceptible of low prices of sale to the consuming public, thereby making such suspended storage assemblies economically available to the buying public.

Still yet another object of the present invention is to provide a new suspended storage assembly which provides in the apparatuses and methods of the prior art some of the advantages thereof, while simultaneously overcoming some of the disadvantages normally associated therewith.

Yet an even further object of the present invention is to provide a new suspended storage assembly comprising a storage basket arranged for pivoted mounting to a ceiling structure such as in a garage and the like, wherein support flanges pivotally mount the basket therebetween, with the support flanges including latch means for securement of the basket in a horizontal orientation and wherein actuation means are provided to selectively release the latch means to permit pivotal movement of the basket to a vertical orientation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
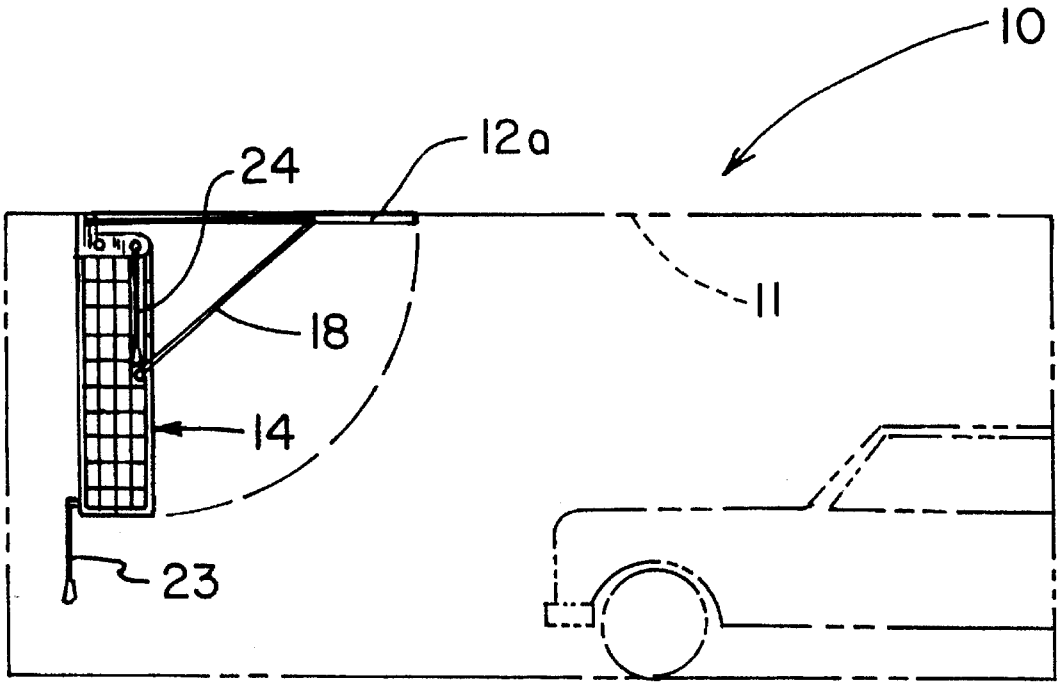
FIG. 1 is an orthographic view of the storage basket in a lowered vertical orientation.

With reference now to the drawings, and in particular to FIGS. 1 to 7 thereof, a new suspended storage assembly embodying the principles and concepts of the present invention and generally designated by the reference numeral 10 will be described.

Figure 2:
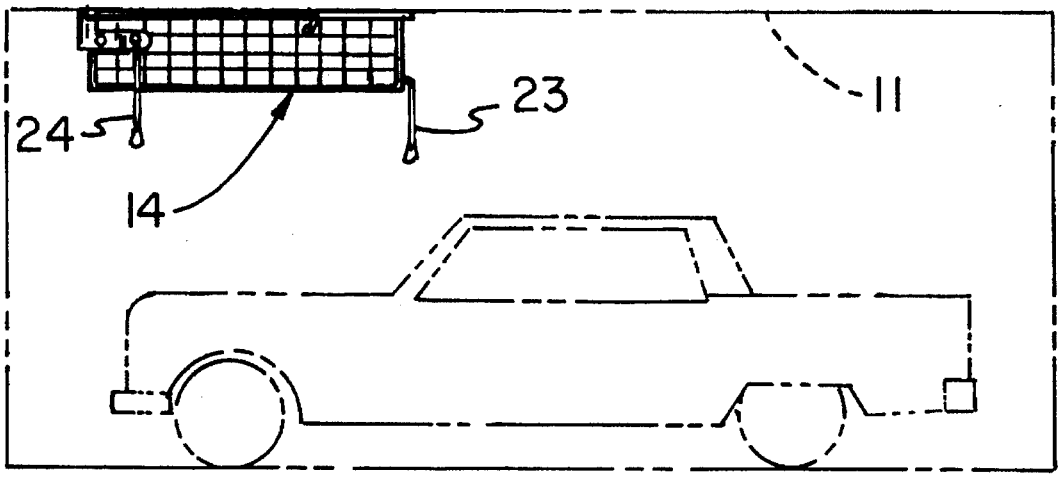
FIG. 2 is an orthographic view of the invention with the basket in a raised horizontal orientation.
Figure 4:
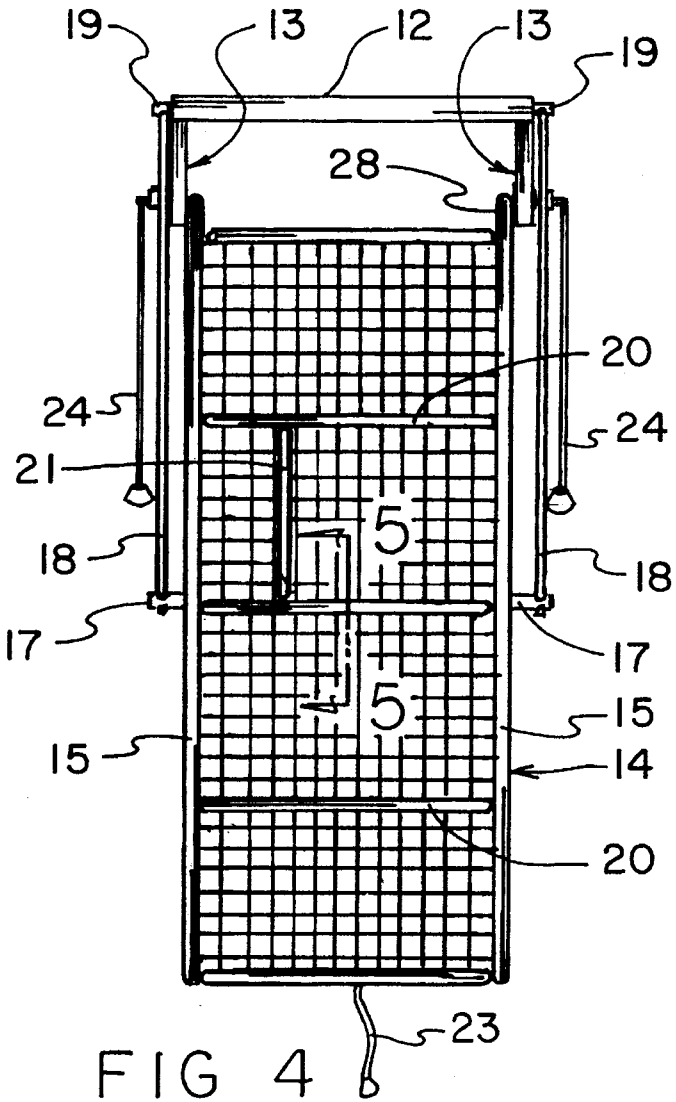
FIG. 4 is an orthographic frontal view of the basket positioned in a lowered orientation.
Figure 3:
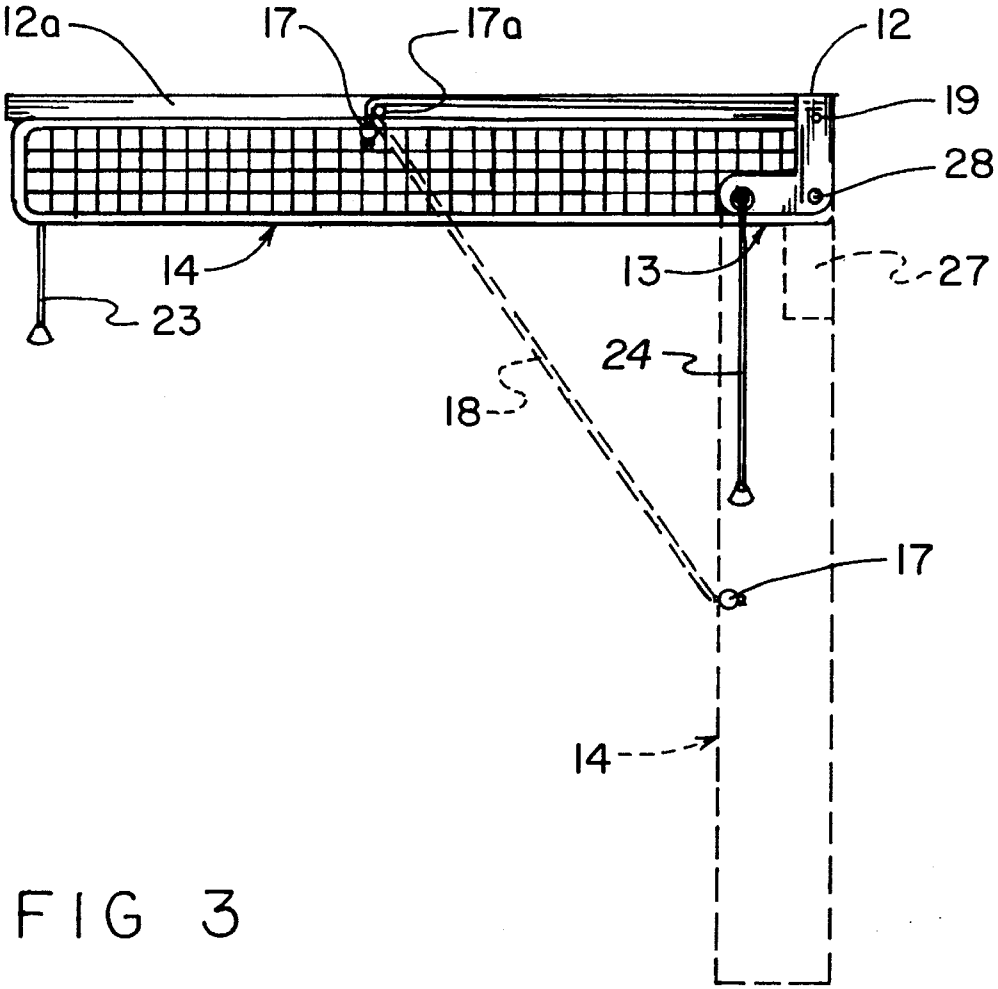
FIG. 3 is an enlarged orthographic view of the basket in a horizontal orientation indicating its manipulation to a vertical orientation in phantom.
Figure 7:
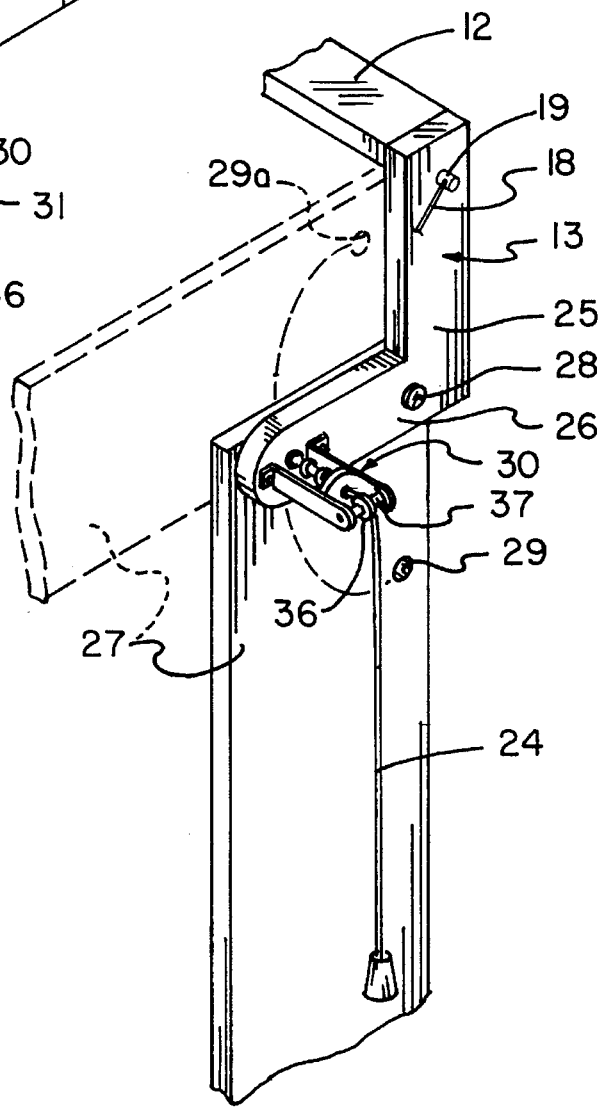
FIG. 7 is an isometric illustration of the latch structure relative to the support plates of the basket.

More specifically, the suspended storage assembly 10 of the instant invention may be mounted to a ceiling 11, such as in a garage as indicated in FIGS. 1 and 2. The invention 10 comprises a mounting plate 12 having rectangular mounting plate framework 12*a* which may be mounted to the ceiling 11 as shown in FIGS. 3,4 and 7 by threaded fasteners or the like which project therethrough and engage the ceiling. A pair of L-shaped support flanges 13 are orthogonally and integrally mounted to the mounting plate 12 so as to be suspended therefrom. The support flanges 13 are spaced apart a predetermined distance to receive a mesh basket member 14 therebetween.

As best illustrated in FIGS. 3 an 4, the basket member 14 includes mesh side walls, a mesh floor, and mesh end walls, with basket side wall frame portions 15 forming a perimeter framework for each of the side walls. An anchor rod 17 extends orthogonally from each of the side wall frames 15 and a limit cable 18 extends from each of the anchor rods 17, over a limit cable peg 17*a*, and to a mounting plate axle 19 directed through the mounting plate 12. The limit cables 18 allow, but yet limit, a pivoting of the basket member 14 from a horizontal first position, such as illustrated in FIG. 2, to a vertical second position, as illustrated in FIG. 1.

Figure 5:
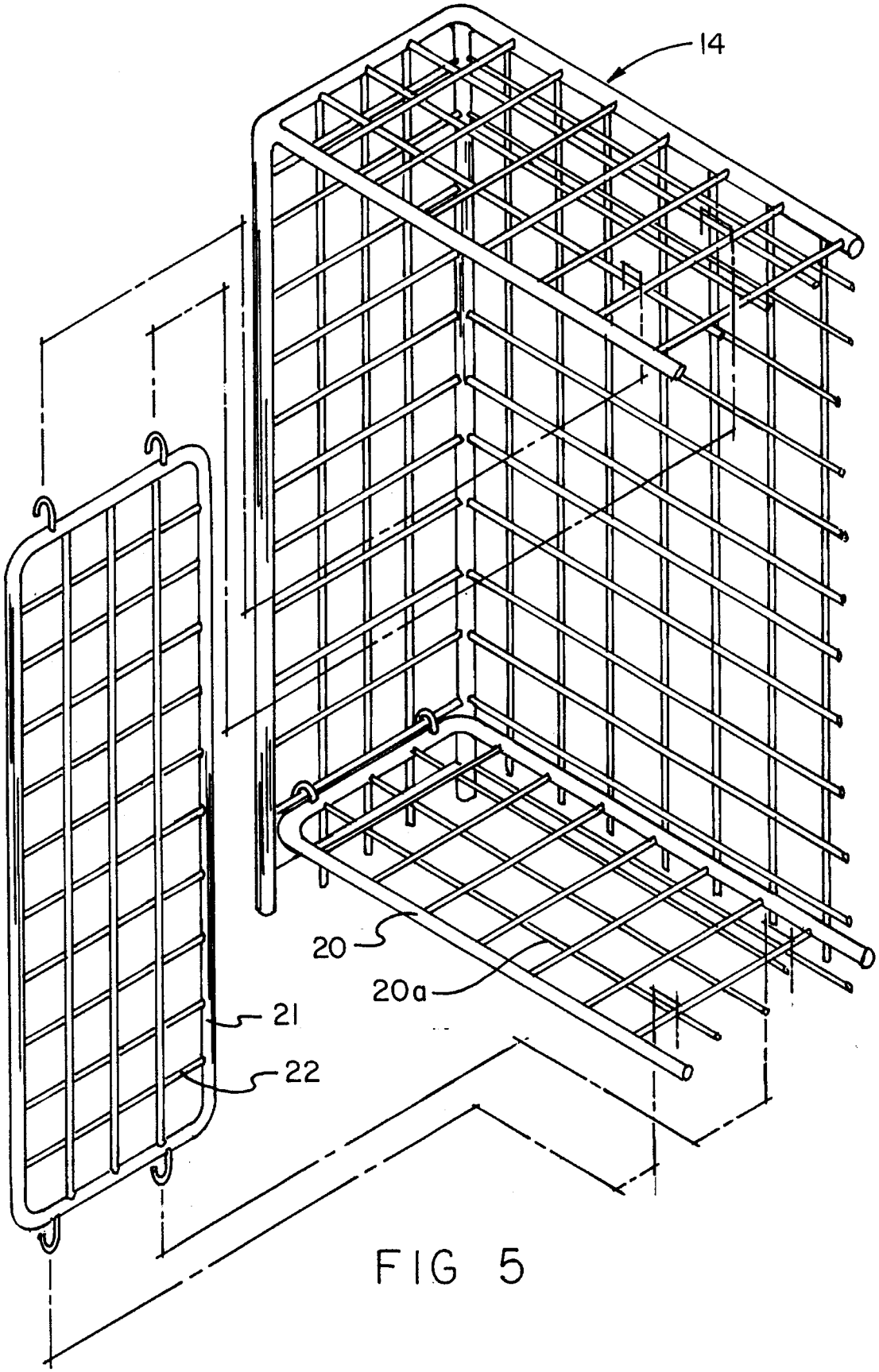
FIG. 5 is an isometric exploded partial view of the basket structure.
Figure 6:
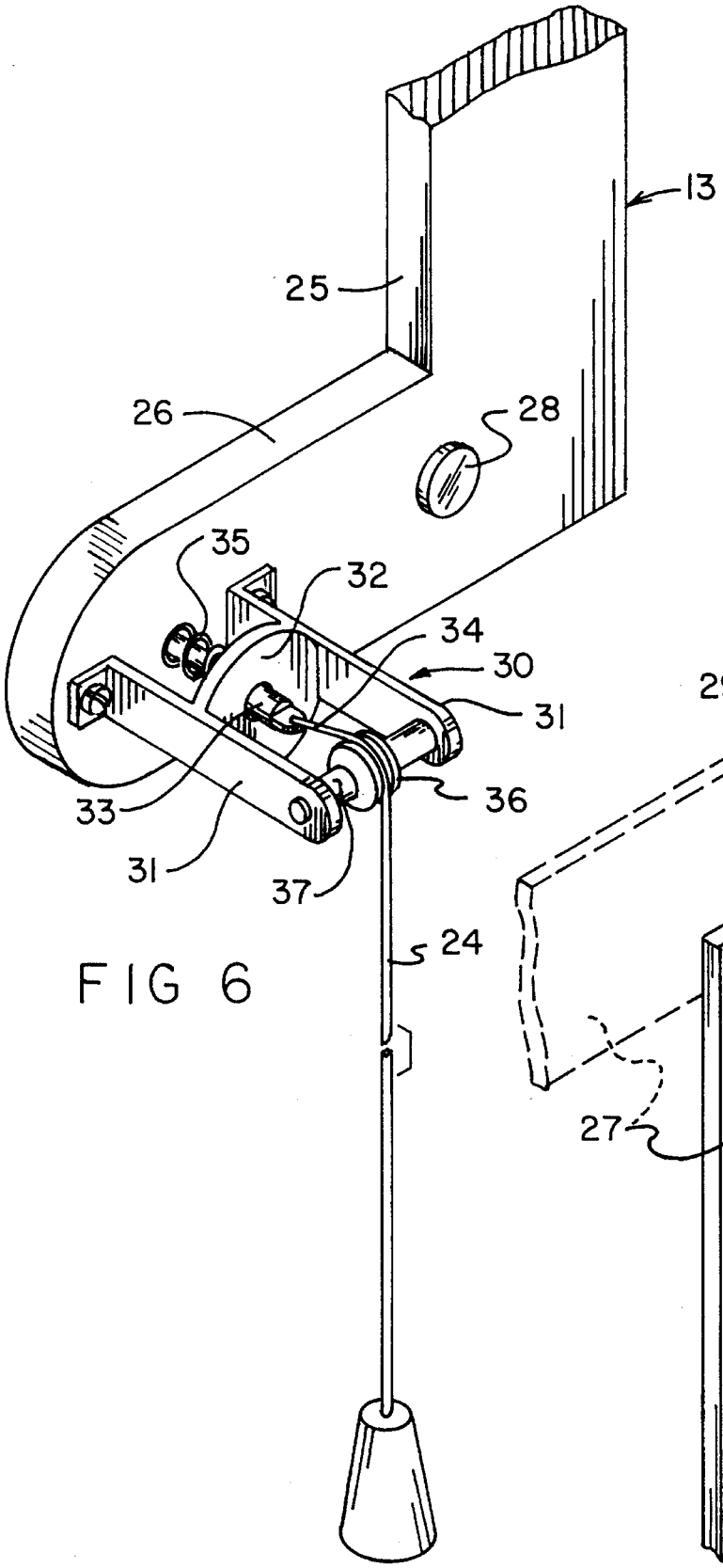
FIG. 6 is an isometric illustration of the latch structure.

As best shown in FIGS. 4 and 5, a plurality of shelf frame members 20 extend orthogonally between the side wall frames 15 of the basket 14, each having a shelf mesh web 20*a*. A partition frame 21 is movably mounted orthogonally between spaced shelf frame members 20 to partition spacing along the shelf frame member between the side wall frames 15. It should be noted that a mesh construction of the basket member 14 minimizes suspended weight relative to the ceiling structure 11 in use. Further, the partition frame 21 is formed with a partition frame mesh web 22 for weight savings as well as ease of visibility within the mesh basket member 14.

As shown in FIGS. 2 and 3, a pull cable 23 is mounted to the basket member 14 at a forward end thereof. Also, such as indicated in the FIG. 4 for example, at least one latch cable 24 is provided, and typically a latch cable relative to each of the support flanges 13 is provided. It should be understood that the latch cables 24 may be tied together also in association with the pull cable 23, such that a single pull upon the connected pull cable 23 and the latch cables 24 simultaneously unlatches the basket member 14 relative to the support flanges 13.

The basket 14 is pivotally mounted to the mounting plate 12 and may be pivoted relative to the associated mounting framework 12*a*. To this end, each of the support flanges 13 includes a first plate 25 orthogonally mounted to the mounting plate 12, with a second plate 26 orthogonally mounted to the first plate 25 and spaced from the mounting plate, as best illustrated for one of the flanges in FIG. 7. The basket member 14 further includes a side wall support plate 27 mounted to and within each of the side wall frames 15 in adjacency to the support flange 13. Each of the side wall support plates 27 of the basket member 14 includes a pivot axle 28 pivotally mounting the side wall support plate to the second plate 26 of the respective flange 13, with the pivot axles 28 coaxially aligned relative to one another relative to each of the support flanges 13. Each of the side wall support plates 27 further includes bolt receiving bores 29 and 29*a*, each spaced from the pivot axle 28, with the bolt receiving bores 29 and 29*a* being arranged to receive a lock bolt 33 removably therewithin.

The latch cables 24 are each operatively connected to a latch structure, as illustrated in the FIGS. 5 and 7. More specifically, a latch assembly 30 is provided and mounted onto the second plate 25. The latch assembly includes a plurality of spaced parallel latch plates 31 orthogonally mounted to the second plate 26, with a cross plate 32 extending orthogonally between the latch plate 31. A lock bolt 33 is slidably received through the second plate 25 and through the cross plate 32. The latch cable 24 extends about a pulley 36 rotatably mounted about a pulley axle 37 directed orthogonally through the latch plates 31. A spring 35 having first and second ends is captured between the cross plate 32 at the first end thereof, and the spring is secured to the lock bolt 33 at the second end thereof to bias the lock bolt 33 through the second plate 25.

The lock bolt 33 is arranged for reception within the bolt receiving bore 29 when the basket member is in a first or horizontal position, such as indicated in FIG. 2, whereupon separation of the lock bolt 33 from the bolt receiving bore 29 of each of the side wall support plates 27 permits pivoting of the basket 14 about the pivot axles 28 to a second or vertical position, as indicated in FIG. 1. Pivoting the basket member 14 back to the first position permits the bolt receiving bore 29 to receive the lock bolt 33, thereby to retain the basket in a horizontal position. Further, as indicated in phantom, each of the support plates 27 may include a further bolt receiving bore 29*a* to receive the lock bolt 33 when the basket member is in the second position, thereby to permit latching of the basket member in the second position if so desired.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, arc deemed readily apparent and obvious to one skilled in the art, and all equivalent relationships to those illustrated in the drawings and described in the specification arc intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A suspended storage assembly comprising:

a mesh basket member having side wall frames, with the side wall frames including a mesh side wall, with a mesh floor extending between the side wall frames, each of the side wall frames including a side wall support plate, and the basket member further including end walls;

a mounting plate, the mounting plate having spaced parallel L-shaped support flanges extending orthogonally from the mounting plate, with the L-shaped support flanges arranged in a parallel coextensive relationship relative to one another; each of the support flanges including a pivot axle, with each pivot axle arranged in a coaxially aligned relationship relative to one another, with each side wall support plate of said side wall support plates receiving an individual one of said pivot axles therethrough permitting pivoting of the basket member relative to the support flanges.

2. A storage assembly as set forth in claim 1, and further including a pull cable mounted to the basket member for manual pulling of the basket member from a first position when the basket member is in a first horizontal position to a second position when the basket member is in a second vertical position.

3. A storage assembly as set forth in claim 2, wherein the basket member includes at least one shelf frame member mounted therewithin and extending orthogonally between the side wall frames; and further comprising at least one partition frame extending parallel to the side wall frames and being selectively mounted to the at least one shelf frame member.

4. A storage assembly as set forth in claim 3, wherein each support flange includes a first plate and a second plate, with the first plate orthogonally mounted to said mounting plate and said second plate orthogonally mounted to said first plate; and further comprising at least one latch assembly mounted to said second plate of one of the support flanges, with the latch assembly having spaced latch plates, and a cross plate orthogonally directed integrally between the latch plates, the cross plate being spaced from and parallel to the second plate, with a lock bolt slidably received through the cross plate and the second plate, and a latch cable extending from the lock bolt, with at least one of said support plates having a bolt receiving bore arranged to receive the lock bolt in the first position.

5. A storage assembly as set forth in claim 4, and further including a pulley axle mounted orthogonally between the latch plates spaced from the cross plate, with a pulley mounted rotatably about the pulley axle, with the latch cable extending about the pulley.

6. A storage assembly as set forth in Claim 5 including a further bolt receiving bore directed through said support plate spaced from the bolt receiving bore to permit reception of the lock bolt within the further bolt receiving bore when the basket member is in the second position.

7. A storage assembly comprising:

a mesh basket member having side wall frames, with the side wall frames including a mesh side wall, with a mesh floor extending between the side wall frames, each of the side wall frames including a side wall support plate, and the basket member further including end walls; and, means for suspending said basket member from a ceiling, whereby said basket member can be pivoted from a horizontal first position wherein the basket member is substantially parallel and adjacent to said ceiling, to a vertical second position wherein the basket member is substantially orthogonal to said ceiling.

* * * * *